US011407129B2

(12) United States Patent
Betancourt et al.

(10) Patent No.: US 11,407,129 B2
(45) Date of Patent: Aug. 9, 2022

(54) CUTLERY IMPLEMENT WITH CONTINUOUS LONGITUDINAL RIDGE

(71) Applicant: Sunbeam Products, Inc., Boca Raton, FL (US)

(72) Inventors: Jose A. Betancourt, Lake Worth, FL (US); Matthew Allen Johnson, South Haven, MI (US); Adam Frumoff, Boynton Beach, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 16/664,052

(22) Filed: Oct. 25, 2019

(65) Prior Publication Data

US 2020/0139563 A1 May 7, 2020

Related U.S. Application Data

(60) Provisional application No. 62/755,159, filed on Nov. 2, 2018.

(51) Int. Cl.
*B26B 9/00* (2006.01)
*B25G 1/10* (2006.01)

(52) U.S. Cl.
CPC ..... *B26B 9/00* (2013.01); *B25G 1/102* (2013.01)

(58) Field of Classification Search
CPC ..... B26B 9/00; B26B 9/02; B25G 1/102
USPC ..... 30/165, 152
See application file for complete search history.

(56) References Cited

U.S. PATENT DOCUMENTS

D125,774 S * 3/1941 Madan ..... D7/650
2,279,833 A * 4/1942 Madan ..... B26B 9/00 30/353
2,566,112 A * 8/1951 Barnard ..... B26B 9/00 30/357
4,495,698 A * 1/1985 Gerber, Jr. ..... B26B 9/00 30/357
5,058,305 A * 10/1991 Majesty ..... B25G 1/046 42/94
D324,326 S * 3/1992 Lu ..... D7/649
5,241,883 A * 9/1993 Coppier ..... B26B 9/00 30/346
5,572,794 A * 11/1996 Kalbern ..... B26B 9/02 30/353
5,787,591 A * 8/1998 Lu ..... B26B 9/02 30/355
D448,253 S * 9/2001 Staib, Jr. ..... B26B 9/00 D7/649
D573,850 S * 7/2008 Curtin ..... D7/649
(Continued)

*Primary Examiner* — Evan H MacFarlane
*Assistant Examiner* — Fernando A Ayala
(74) *Attorney, Agent, or Firm* — Husch Blackwell LLP

(57) ABSTRACT

A cutlery implement or cutting instrument having a blade with opposed side surfaces, a knife edge extending along one terminal edge of the blade, and a narrow continuous longitudinally extending ridge of either hemispherical cross-sectional shape or rectangular cross-sectional shape extending along a pre-determined length of the knife edge at a pre-determined continuous spaced distance from the knife edge. The rectangular cross-sectional shape includes fillets on each opposite side thereof for providing a smooth transition to the blade surface. The narrow longitudinally extending ridge protrudes from at least one or both of the opposed side surfaces of the blade.

5 Claims, 4 Drawing Sheets

(56) References Cited

U.S. PATENT DOCUMENTS

| | | | | | |
|---|---|---|---|---|---|
| D678,734 | S | * | 3/2013 | Harris | D7/649 |
| D690,562 | S | * | 10/2013 | Hasegawa | D7/649 |
| 2008/0276467 | A1 | * | 11/2008 | Schmidt | B26B 3/00 30/340 |
| 2012/0198707 | A1 | * | 8/2012 | Blacken | A47J 17/02 30/346 |
| 2019/0160697 | A1 | * | 5/2019 | Henry | B26B 9/00 |

* cited by examiner

CUTLERY IMPLEMENT WITH CONTINUOUS LONGITUDINAL RIDGE

CROSS-REFERENCE TO RELATED APPLICATIONS

This Applications claims priority to U.S. Provisional Patent Application Ser. No. 62/755,159, filed on Nov. 2, 2018, entitled "Cutlery Implement with Continuous Longitudinal Ridge," the entire disclosure of which is incorporated herein by reference.

FIELD OF THE INVENTION

The present invention is directed generally to cutlery implements such as cutting knives and the like and, more particularly, to a cutlery implement having a narrow longitudinal protrusion of a specific shape on each side of the cutting blade for separating food stuff from the blade during a food preparation process.

BACKGROUND OF THE INVENTION

Many different types of cutlery implements are known in the art. Many such implements are knives configured for use in the preparation of a wide variety of different food products. It is well known in the industry that some types of food, after being cut, tend to stick to the blade of the knife or other implement. Manufacturers have attempted a wide variety of different types of solutions to help release food or other cut items from the blade. For example, many manufacturers simply use non-stick coatings on the blades to help solve the problem of food stuff sticking to the blade of the knife during food preparation. Although these non-stick coatings provide some relief, none of them provide sufficient food release properties.

Other manufacturers have attempted to create a wide variety of different types of protrusions on the blade but due to manufacturing restrictions, many of these protrusions are present only on one side of the blade thereby making the blade suitable for only a left handed or a right handed user. Some of these protrusions include a plurality of bumps positioned in spaced apart relationship on each of the opposed side surfaces of a particular blade, and some of these protrusions include a plurality of depressions intermittently positioned between the plurality of bumps on each of the opposite side surfaces of a particular blade.

Still further, some blades are provided with a plurality of kullens along the length of a particular blade, the kullens being placed near the knife edge of the blade. Kullens are depressions or recesses formed in the material of the knife blade.

Still other knives include what is called a granton-style blade which includes a plurality of intermittently spaced scallops that are formed in the side surfaces of the knife blade. These scallops typically continue right to the knife edge.

Still other manufacturers utilize a specialized paint on the surface of the blade to act as a non-stick coating.

For many types of food products, these solutions do not perform as intended and, in some instances, the recesses or depressions formed in the side surface of the blade actually create additional suction for holding and retaining food items on the blade.

It is therefore desirable to provide an improved cutlery implement which more efficiently and better solves the problem of food stuff sticking to the blade of the knife during a food preparation process. It is also desirable to provide a cutlery implement with a blade that cuts faster and easier and also allows for ambidextrous use.

Accordingly, the present invention is directed to overcoming one or more of the problems as set forth above.

SUMMARY OF THE INVENTION

In accordance with the teachings of the present invention, a cutlery implement is provided with a blade that has a narrow continuous longitudinal protrusion or ridge formed on both sides of the blade, the longitudinal ridge or protrusion extending from the bolster of the cutting instrument, at a continuous constant distance from the cutting edge of the blade, along substantially the entire length of the cutting blade, the longitudinal ridge or protrusion blending into the face of the blade as it approaches the tip of the blade. In another embodiment, the longitudinal ridge or protrusion extends from a location spaced from the bolster of the cutting instrument, at a continuous constant distance from the cutting edge, to a position located near or adjacent to the tip of the blade. The present ridge or protrusion can take the form of two different geometries, namely, one geometry being in the form of a rectangular cross-sectional profile with fillets on each side thereof to transition into the surface of the blade, and the other geometry being in the form of a hemispherical cross-sectional profile. The elevation of the ridge or protrusion relative to the surface of the blade is preferred to be in the range of 0.4 mm+/−0.1 mm.

The present narrow longitudinal protrusion or ridge can be incorporated into any cutlery implement in accordance with the teachings of the present invention.

Still other objects and advantages of the present invention will become apparent to those skilled in the art.

BRIEF DESCRIPTION OF THE DRAWINGS

For a better understanding of the present invention, reference may be made to the accompanying drawings.

Figure 1:
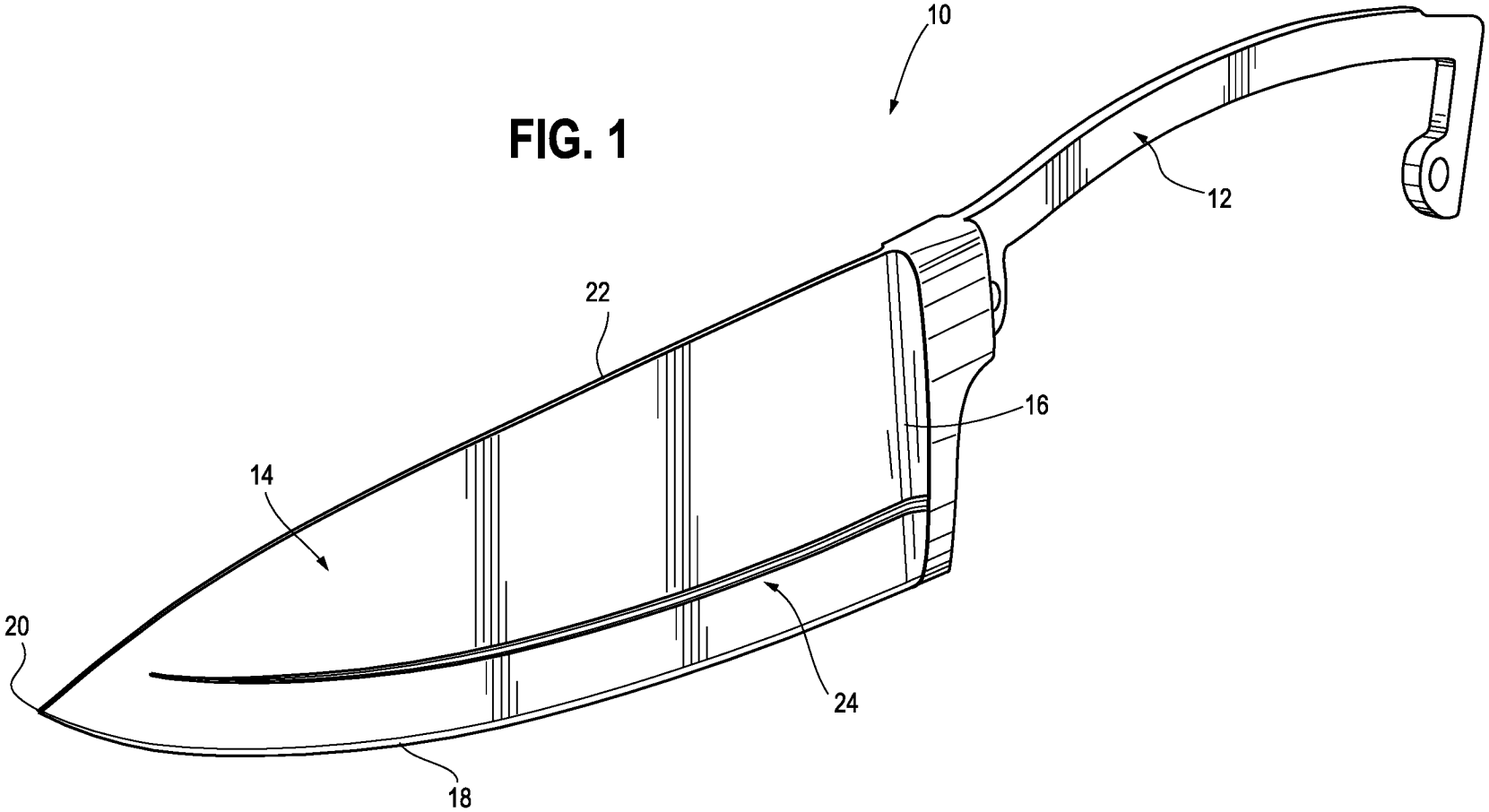
FIG. 1 is a perspective view of one embodiment of a cutlery implement constructed in accordance with the teachings of the present invention.

While the disclosure herein is susceptible to various modifications and alternative forms, specific embodiments thereof are shown by way of example in the drawings and will hereinafter be described in detail. It should be understood, however, that the drawings and detailed description presented herein are not intended to limit the disclosure of the present invention to the particular embodiments disclosed but on the contrary, the intention is to cover all modifications, equivalents, and alternatives falling within the spirit and scope of the present disclosure.

DETAILED DESCRIPTION OF THE INVENTION

Referring to the drawings more particularly by reference numbers wherein like numbers refer to like parts, FIG. 1 illustrates one embodiment of the present cutting instrument 10 constructed according to the teachings of the present invention. Cutting instrument or knife 10 includes a handle tang portion 12, a blade 14 and a bolster 16. The handle tang portion 12 is structured for receiving a handle grip (not shown) which is typically ergonomically configured so as to conform to a user's hand. The size and shape of the handle grip and handle tang portion 12 can vary widely depending upon the size of the cutting instrument or knife 10 and its particular application.

The blade 14 has a knife edge 18 located along one terminal edge portion of the blade which is the cutting edge of the instrument. The knife edge 18 generally extends from the bolster 16 to a blade tip 20, as illustrated in FIG. 1. The blade 14 will typically include a blunt top edge portion 22, which extends generally opposite the knife edge 18. In the embodiment illustrated in FIG. 1, the blunt top edge 22 curves slightly downward towards the blade tip 20 and the knife edge 18 curves upwardly towards the blade tip 20 until the two edges meet at the blade tip 20. As is well known in the art, the blade edge 18 is the cutting edge of the blade for cutting a wide variety of various objects such as various food products.

The bolster 16 is a thick junction between the handle tang 12 and the knife blade 14 which provides a smooth transition from the blade to the handle. The bolster 16 also strengthens the knife, adds durability, and provides a counterbalance. The bolster 16 also helps to keep the fingers of a user from slipping while using the knife. The blade 14, handle tang 12 and bolster 16 can be formed as a unitary structure from steel or some other suitable material. The handle grip (not shown) is typically secured to the handle tang 12 in a conventional manner as known in the art.

In the embodiment illustrated in FIG. 1, a narrow continuous longitudinally extending protrusion or ridge 24 extends on both sides of the blade 12 from the bolster 16 to a location in the vicinity of the blade tip 20 as best illustrated in FIG. 1. The protrusion or ridge 24 extends across the bottom portion of the blade 14 at a continuous constant predetermined distance from the blade edge 18. In a preferred embodiment, the protrusion or ridge 24 extends at a continuous constant distance of about 10 mm from the cutting edge 18 and, in a preferred embodiment, the elevation of the ridge or protrusion above the surface of the blade 14 is about 0.35 mm+/−0.05 mm. In a preferred embodiment, the maximum thickness of the ridge or protrusion is about 1.8 mm+/−0.3 mm measured from side to side at the blade surface. In another embodiment, the elevation of the ridge or protrusion 24 relative to the blade surface is about 0.4 mm+/−0.1 mm.

Figure 2:
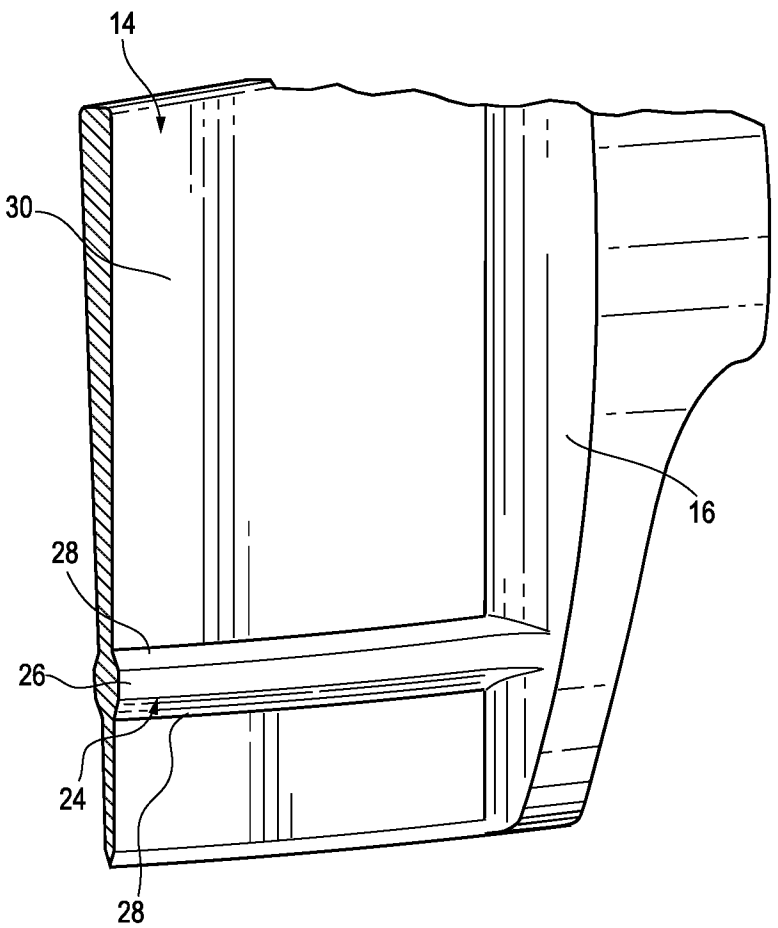
FIG. 2 is partial perspective view illustrating one embodiment of the present longitudinally extending ridge wherein the ridge has a rectangular cross-sectional profile with fillets.

In one embodiment as best illustrated in FIG. 2, the narrow continuous longitudinally extending protrusion or ridge 24 has a rectangular cross-sectional shape 26 with a pair of fillet portions, or fillets, 28 positioned on each opposite side thereof for providing a smooth transition into a blade surface 30. This geometric profile helps to separate food stuff from the blade during food preparation thereby preventing sticking.

Figure 3:
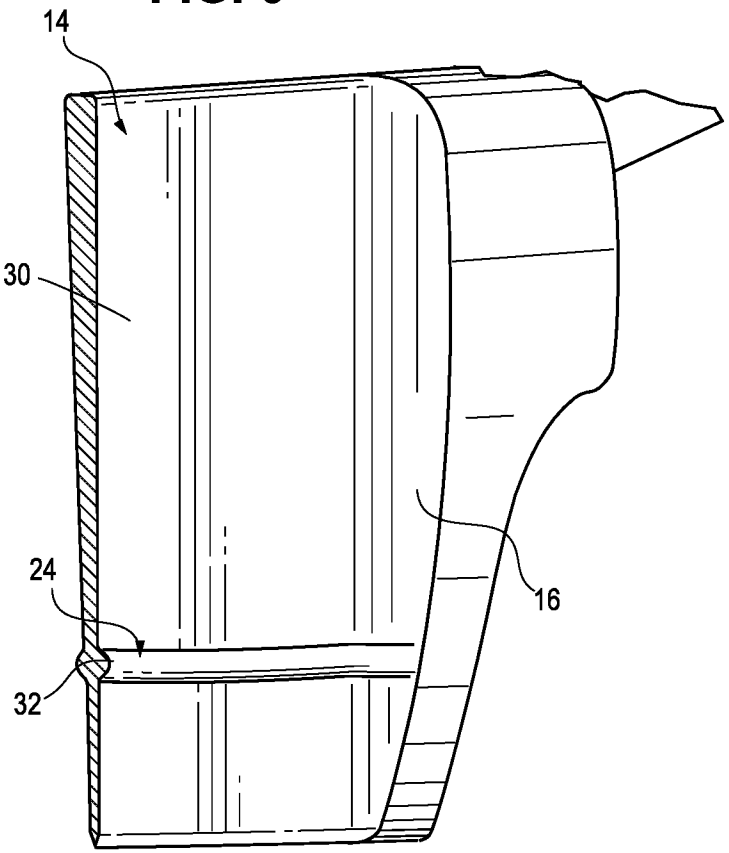
FIG. 3 is partial perspective view illustrating another embodiment of the present longitudinally extending ridge wherein the ridge has a hemispherical cross-sectional profile.

In still another embodiment as best illustrated in FIG. 3, the present narrow continuous longitudinally extending protrusion or ridge 24 can likewise take on the geometric profile of a hemispherical cross-sectional shape 32 as best illustrated in FIG. 3. The hemispherical cross-sectional shape likewise provides a ridge with an arcuate or curved upper surface which again helps to separate food stuff from the blade during food preparation.

The surface of the knife blade 14 can be grid blasted to a surface roughness of 4 μm and can likewise be coated with a PTFE based coating thickness of about 18 μm. This combination of both a narrow continuous longitudinally extending protrusion or ridge 24 along with a non-stick coating further ensures that food stuff will not stick to the knife blade 14 during food preparation.

The narrow longitudinal protrusion or ridge 24, regardless of whether it is hemispherical or rectangular in cross-sectional shape, is a single continuous ridge running lengthwise across the bottom portion of the blade 14 from the bolster 16 to a location in the vicinity of the blade tip 20, the ridge 24 being spaced at a continuous constant pre-determined distance from the blade edge 18 all along its length. Although it is preferred that the narrow longitudinally extending ridge 24 be located on both opposite sides of the blade 14, it is also recognized and anticipated that the present continuous longitudinal ridge structure can be utilized on just one side of the blade 14.

Figure 4:
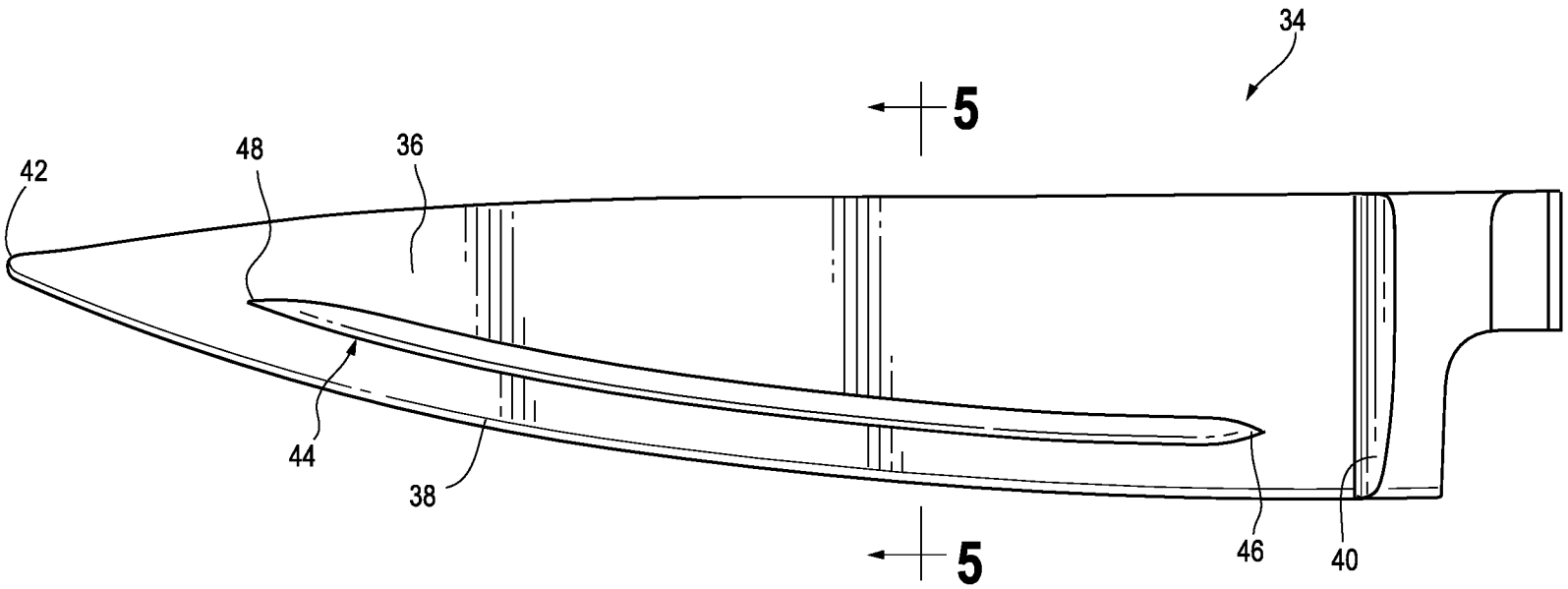
FIG. 4 is a side elevational view of another embodiment of the present cutlery implement constructed according to the teachings of the present invention.
Figure 6:
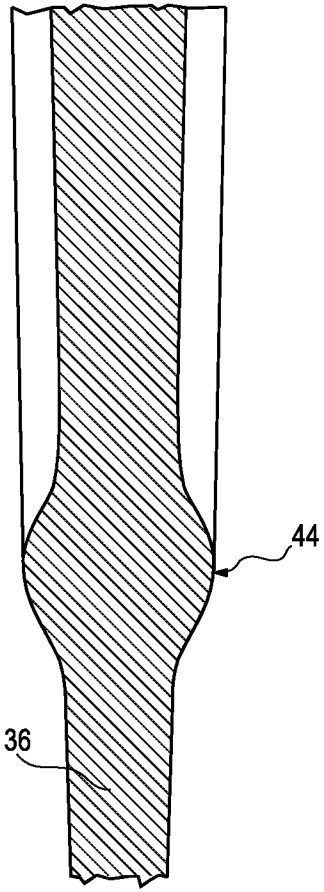
FIG. 6 is an enlarged cross-sectional view of detail B illustrated in FIG. 5.
Figure 5:
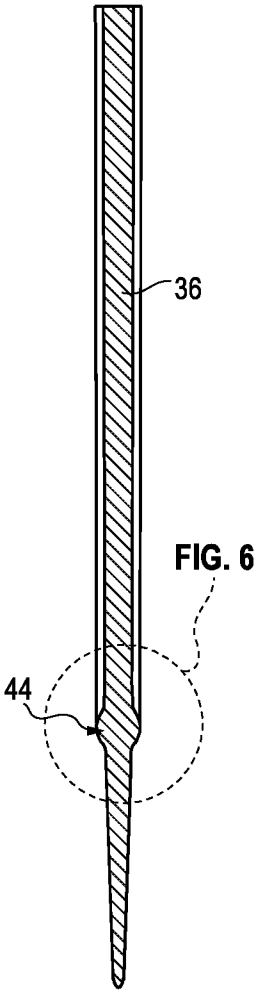
FIG. 5 is cross-sectional view of the implement of FIG. 4 taken along line A-A of FIG. 4.

FIGS. 4-6 illustrate still another embodiment of the present cutting implement wherein an alternative cutting implement 34 again includes a blade 36, a blade cutting edge 38, a bolster 40 and a blade tip 42. Implement 34 includes a narrow continuous longitudinally extending protrusion or ridge 44 which again extends on both sides of the blade 36 similar to longitudinally extending protrusion or ridge 24 except that the protrusion or ridge 44 does not extend from or abut the bolster 40. Instead, the narrow continuous longitudinal ridge 44 starts at a location spaced from the bolster 40 as best illustrated in FIG. 4.

Here again, the narrow longitudinally extending ridge 44 is spaced at a constant predetermined distance from the blade cutting edge 38, such as at a preferred distance of 10 mm, and it extends along the bottom portion of blade 36 to a location in the vicinity of and spaced from the blade tip 42 as again best illustrated in FIG. 4. The opposite end portions 46 and 48 of ridge 44 taper and blend into the surface face of the blade 36. Like the narrow longitudinally extending protrusion or ridge 24, ridge 44 can likewise take on either a rectangular cross-sectional shape with corresponding fillets as described above with respect to FIG. 2, or ridge 44 can take on a hemispherical cross-sectional shape as described above with respect to FIG. 3. In the particular embodiment illustrated in FIGS. 4-6, the longitudinally extending ridge 44 is shown as being hemispherical in cross-sectional shape, as best illustrated in FIG. 6. Except for opposite end portion 46 of ridge 44 being spaced from the bolster 40, the construction, location and positioning of ridge 44 is substantially identical to the construction, location and positioning of ridge 24 discussed above. Here again, the maximum thickness and elevation of ridge 44 is substantially identical to the maximum thickness and elevation of ridge 24 as previously explained.

It is recognized and anticipated that the overall length of the narrow continuous longitudinally extending ridges 24 and 44 can vary depending upon the particular cutting implement, and it is also recognized and anticipated that the maximum thickness of the ridge as measured from side to side at the blade surface as well as the elevation of the ridge relative to the blade surface can likewise vary depending upon the particular cutting implement and its particular application. Still further, the starting point of the present narrow ridge such as opposite end portion 46 and its end point such as opposite end point 48 can likewise vary between abutting the bolster 16 as illustrated in FIG. 1 to being spaced from the bolster 40 at any pre-determined distance as illustrated in FIG. 4 depending upon the particular cutting instrument as well as its particular application. It is also recognized that on certain cutting instruments, the present narrow continuous longitudinally extending ridges 24 and 44 can be spaced from the cutting edge of the instrument at any particular pre-determined distance and such ridges 24 and 44 can be located on one or both sides of the knife blade. Still further, the fillets 28 illustrated in FIG. 2 with respect to the rectangular profile of ridge 24 can likewise take on a wide variety of different shapes as long as there is a relatively smooth transition from the top portion of the ridge to the blade surface.

It is also recognized and anticipated that any non-stick coating can be used in conjunction with the present ridges 24 and 44 to further improve the separability of food stuff from the implement blade during a particular food preparation process. In this regard, it is also recognized and anticipated that the thickness of the coating can vary depending upon the particular cutting instrument and its application and the surface of the knife blade can likewise include a grid blasted surface having varying roughnesses again depending upon the particular application.

It is also recognized and anticipated that various blade materials and manufacturing processes can be used to fabricate the cutlery implements or knives disclosed herein in accordance with the teachings of the present invention. It is also recognized that the present invention is likewise suitable for virtually any type of cutting implement and for cutting any type of material that requires cutting. Cutting instruments configured as described herein can greatly enhance release from the blade of those items that are being cut thereby preventing sticking of those items to the cutting blade surface. The present invention is also applicable to rotary slicers, choppers, mandolin-type food slicers and other industrial applications.

The terms "protrusion" and "ridge" are generally used herein to describe the raised elements on the blade side surfaces. Use of these terms is not intended to limit in any way the type of protruding or raised element.

Thus, there has been shown and described several embodiments of a cutlery implement or cutting instrument which includes a narrow continuous longitudinally extending protrusion or ridge that helps to separate food stuff from the blade surface during food preparation. As is evident from the foregoing description, certain aspects of the present invention are not limited by the particular details of the examples illustrated herein, and it is therefore contemplated that other modifications, applications, variations or equivalents thereof, will occur to those skilled in the art. Many such changes, modifications, variations and other uses and applications of the present constructions will, however, become apparent to those skilled in the art after considering this specification and the accompanying drawings. All such changes, modifications, variations and other uses and applications which do not depart from the spirit and scope of the present invention are deemed to be covered by the invention which is limited only by the disclosure set forth above.

What is claimed is:

1. A cutlery implement comprising:

a blade having opposed side surfaces, a knife edge along one terminal edge portion of the blade, and a top edge opposite the knife edge;

a bolster; and a continuous longitudinally extending ridge on each of the opposed side surfaces of said blade, each said continuous longitudinally extending ridge extending along a pre-determined length of the knife edge and being spaced at a constant pre-determined distance from the knife edge along the pre-determined length of the knife edge, wherein each continuous longitudinally extending ridge is located at a distance of about 10 mm from the knife edge along the length of the blade;

wherein each continuous longitudinally extending ridge abuts and extends from the bolster to a location adjacent to but not abutting a tip of the blade;

wherein each continuous longitudinally extending ridge is of a hemispherical cross-sectional shape;

wherein a maximum thickness of each continuous longitudinal ridge is 1.8 mm+/−0.3 mm measured from side to side at the blade surface;

wherein an elevation of each ridge relative to the blade surface is 0.4 mm+/−0.1 mm; and wherein the bolster extends from the knife edge of the blade to the top edge of the blade.

2. The cutlery implement defined in claim 1 wherein the continuous longitudinally extending ridge has opposed end portions, each opposed end portion tapering into the blade surface.

3. The cutlery implement defined in claim 1 wherein the elevation of the ridge relative to the blade surface is 0.35 mm+/−0.05 mm.

4. A cutlery implement comprising:

a blade having opposed side surfaces, a knife edge along one terminal edge portion of the blade, and a top edge opposite the knife edge;

a continuous longitudinally extending ridge on at least one of the opposed side surfaces of said blade, said continuous longitudinally extending ridge extending along a pre-determined length of the knife edge, wherein the continuous longitudinally extending ridge is located at a distance of about 10 mm from the knife edge along the length of the blade;

wherein the cutlery implement includes a bolster, and the continuous longitudinally extending ridge abuts and extends from the bolster to a location in the vicinity of a tip of the blade;

wherein the continuous longitudinally extending ridge is of a hemispherical cross-sectional shape;

wherein the continuous longitudinally extending ridge extends along a pre-determined length of the knife edge and is spaced at a constant pre-determined distance from the knife edge along the pre-determined length of the knife edge; and wherein the bolster extends from the knife edge of the blade to the top edge of the blade;

wherein the continuous longitudinally extending ridge abuts and extends from the bolster to a location adjacent to but not abutting a tip of the blade.

5. The cutlery implement defined in claim 4 including a continuous longitudinally extending ridge located on both opposed side surfaces of the blade.

* * * * *